US007319831B2

(12) United States Patent
Hong

(10) Patent No.: US 7,319,831 B2
(45) Date of Patent: Jan. 15, 2008

(54) WASTE-SLUDGE DISCHARGING UNIT AND IMAGE FORMING APPARATUS HAVING THE SAME

(75) Inventor: Jong-Cheon Hong, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 224 days.

(21) Appl. No.: 11/179,499

(22) Filed: Jul. 13, 2005

(65) Prior Publication Data

US 2006/0078360 A1 Apr. 13, 2006

(30) Foreign Application Priority Data

Oct. 11, 2004 (KR) ..... 10-2004-0080858

(51) Int. Cl.
*G03G 15/16* (2006.01)
*G03G 21/00* (2006.01)

(52) U.S. Cl. ..... 399/101; 399/358

(58) Field of Classification Search ..... 399/101, 399/249, 348, 358, 360
See application file for complete search history.

(56) References Cited

U.S. PATENT DOCUMENTS 5,534,988 A * 7/1996 Gerbasi ..... 399/358
5,970,303 A * 10/1999 Bares et al. ..... 399/358
6,266,511 B1 * 7/2001 Murakami et al. ..... 399/358
6,546,225 B2 * 4/2003 Wang ..... 399/358
6,879,804 B2 * 4/2005 Park ..... 399/348

FOREIGN PATENT DOCUMENTS

| | | |
|---|---|---|
| KR | 1998-015272 | 6/1998 |
| KR | 1020020016388 | 3/2002 |
| KR | 2003-0075754 | 9/2003 |
| KR | 2004-0002096 | 1/2004 |
| KR | 2004-020745 | 3/2004 |
| KR | 2004-0024264 | 3/2004 |

* cited by examiner

*Primary Examiner*—William J. Royer
(74) *Attorney, Agent, or Firm*—Roylance, Abrams, Berdo & Goodman, L.L.P.

(57) ABSTRACT

A waste-sludge discharging unit is provided to discharge waste sludge being removed by a cleaning blade from an image carrier. The waste-sludge discharging unit has a waste-sludge receiver to receive waste sludge gravitating from the image carrier. The waste-sludge receiver has an outlet on one side of a bottom thereof. A blade pushes the waste sludge accumulated on the bottom of the waste-sludge receiver toward the outlet. A blade mover operates the blade. The blade operates in contact with the bottom of the waste-sludge receiver only when being moved toward the outlet.

20 Claims, 6 Drawing Sheets

WASTE-SLUDGE DISCHARGING UNIT AND IMAGE FORMING APPARATUS HAVING THE SAME

CROSS-REFERENCE TO RELATED APPLICATION

This application claims benefit under 35 U.S.C. § 119(a) of Korean Patent Application No. 2004-80858, filed Oct. 11, 2004, the entire disclosure of which is hereby incorporated by reference.

BACKGROUND OF THE INVENTION

1. Field of the Invention

The present invention relates to an image forming apparatus. More particularly, the present invention relates to a waste-sludge discharging unit for removing waste sludge remaining on an image carrier of an image forming apparatus.

2. Description of the Related Art

Conventional image forming apparatuses use a developer to form an image. The image is formed by the developer after being transferred from an image carrier such as a photoconductive medium and a transfer belt. The image is formed on the image carrier. After being transferred to a printing medium, the developer typically remains on the image carrier. This is particularly true when a high-density liquid developer is used. Waste developer remains on the image carrier in the form of a sticky lump. The sticky lump is waste sludge comprising a gel clod and waste liquid. Accordingly, the image forming apparatus usually includes a waste-toner discharging unit for removing the waste developer or the waste sludge remaining on the image carrier.

FIG. 1 illustrates an example of a wet-type electrophotographic image forming apparatus which uses a high-density liquid developer and includes a conventional waste-sludge discharging unit.

Referring to FIG. 1, the wet-type electrophotographic image forming apparatus 1 comprises a plurality of photoconductive drums 10 on which an electrostatic latent image is formed by a laser beam emitted from a laser scanning unit (not shown) and developed by different colors of liquid developers T, respectively. A transfer belt 20 is provided on which the images formed on the plurality of photoconductive drums 10 are overlappingly transferred as a color image. A plurality of first transfer rollers 12 transfer the images formed on the photoconductive drums 10 onto the transfer belt 20 and a second transfer roller 30 transfers the color image formed on the transfer belt 20 onto a printing medium P which is supplied to the second transfer roller 30 by a paper feeding unit (not shown). The printing medium P having the color image thereon is transferred by the second transfer roller 30 and discharged after passing through a fixing unit (not shown) and a discharge roller (not shown). Thus, printing is complete.

The transfer belt 20 moves along a caterpillar track by a driving roller 22 and a driven roller 23. Adjacent to the driven roller 23, a cleaning blade 40 is equipped to remove the waste sludge S not transferred to the printing medium P but remaining on the transfer belt 20. A waste-sludge discharging unit 50 is formed on a lower part of the cleaning blade 40 to discharge the waste sludge S removed from the transfer belt 20 to waste-sludge storage 55.

The waste-sludge discharging unit 50 comprises a waste-sludge receiver 51 for receiving the waste sludge S removed from the transfer belt 20 by the cleaning blade 40. The waste-sludge discharging unit 50 also comprises an outlet 52 formed on a bottom of the waste-sludge receiver 51. The waste-sludge receiver 51 has a corresponding size to the cleaning blade 40. Thus, the waste sludge S being removed and gravitating from the cleaning blade 40 can be discharged through the outlet 52 without leaking to the outside of the waste-sludge receiver 51. The waste-sludge storage 55 for storing the discharged waste sludge S is disposed under the outlet 52 of the waste-sludge receiver 51. When filled with the waste sludge S, the waste-sludge storage 55 can be separated for emptying and remounted for reuse.

The process of removing the waste sludge in the image forming apparatus having the waste-sludge discharging unit 50 will now be described.

The electrostatic latent images are formed on the plurality of photoconductive drums 10, respectively, by laser beams emitted from the laser scanning unit in accordance with a printing command. The electrostatic latent images are developed into images of different colors, respectively, by liquid developers T supplied by a developing unit (not shown). The images formed on the plurality of photoconductive drums 10 are overlappingly transferred onto the transfer belt 20 by the respective first transfer rollers 12. Thus, a color image is formed. The color image formed on the transfer belt 20 is transferred onto the printing medium P by the second transfer roller 30. After transfer of the color image, typically portions of the liquid developers T are left on the transfer belt 20. The liquid developers T left is waste sludge S. The waste sludge S comprises a gel lump S1 of high viscosity and a waste liquid S2. While the transfer belt 20 moves along the caterpillar track by the driving and the driven rollers 22 and 23, the waste sludge S remaining thereon is removed therefrom by the cleaning blade 40. The waste sludge S streams along the cleaning blade 40. The waste sludge S streams along the cleaning blade 40 and is received into the waste-sludge receiver 51 and discharged to the waste-sludge storage 55 through the outlet 52 formed on the waste-sludge receiver 51.

In such a waste-sludge discharging unit 50, however, the waste sludge S that gravitates into the waste-sludge receiver 51 may accumulate at certain parts of the waste-sludge receiver 51. Due to the high viscosity of the waste sludge 5, the waste sludge S builds up instead of smoothly flowing out through the outlet 52. Once the waste sludge S starts accumulating on the bottom of the waste-sludge receiver 51, the outlet 52 may clog due to the waste sludge S removed by the cleaning blade 40. The waste sludge S will continue to accumulate in the waste-sludge receiver 51. As a consequence, deterioration of the image and leakage of the developer may result. Thus, replacement of an image cartridge, which includes the transfer belt 20, may be required. In other words, the accumulation of waste sludge S in the conventional waste-sludge discharging unit 50 reduces the lifespan of the image cartridge.

Accordingly, there is a need for a waste-sludge discharging unit for discharging waste sludge removed from an image carrier such as a transfer belt that prevents accumulation of the waste sludge in a waste-sludge receiver and increases the longevity of the image cartridge.

SUMMARY OF THE INVENTION

An aspect of the present invention is to solve at least the above problems and/or disadvantages and to provide at least the advantages described below. Accordingly, an aspect of the present invention is to provide a waste-sludge discharging unit for discharging waste sludge removed from an image carrier such as a transfer belt, to prevent accumulation of the waste sludge in a waste-sludge receiver.

Another aspect of the present invention is to provide an image forming apparatus capable of prolonging the lifespan of an image cartridge by means of a waste-sludge discharging unit which discharges waste sludge removed from an image carrier.

In order to achieve the above-described aspects of the present invention, there is provided a waste-sludge discharging unit comprising a waste-sludge receiver to receive waste sludge removed and gravitating from the image carrier. The waste-sludge receiver has an outlet on one side of a bottom thereof. A blade pushes the waste sludge which accumulates on the bottom of the waste-sludge receiver toward the outlet. A blade mover operates the blade.

The blade operates in contact with the bottom of the waste-sludge receiver only when being moved toward the outlet.

The blade mover comprises a belt configured for mounting the blade, a pair of pulleys to guide a caterpillar motion of the belt, and a motor to drive one of the pair of pulleys.

The blade mover further comprises a guide pin formed on one side of the blade. A guide groove is formed as a substantially closed curve and comprises two linear parts disposed parallel with the bottom of the waste-sludge receiver to movably guide the guide pin.

The blade mover further comprises a sensor to detect the blade. Here, the blade may further comprise a dog part to operate the sensor.

The guide groove is substantially formed as a parallelogram. The guide groove is formed on an inner side of the waste-sludge receiver.

To achieve another aspect of the present invention, there is provided an image forming apparatus comprising an image carrier. A cleaning blade removes waste sludge remaining on the image carrier and a waste-sludge receiver is configured to receive the waste sludge removed. The waste-sludge receiver has an outlet on a bottom thereof and a blade to push the waste sludge which accumulates on the bottom of the waste-sludge receiver toward the outlet. A blade mover operates the blade.

The blade contacts the bottom of the waste-sludge receiver only when being moved toward the outlet.

The blade mover comprises a belt mounted with the blade, a pair of pulleys to guide a caterpillar motion of the belt, and a motor to drive one of the pair of pulleys.

The blade mover further comprises a guide pin formed on one side of the blade. A guide groove is formed as a substantially closed curve and comprises two linear parts disposed parallel with the bottom of the waste-sludge receiver to movably guide the guide pin. Thus, when the guide pin moves along a lower linear part of the guide groove, the blade moves in contact with the bottom of the waste-sludge receiver.

The blade mover further comprises a sensor to detect the blade and a dog part formed on the blade to operate the sensor.

In the above-described waste-sludge discharging unit according to an embodiment of the present invention, the waste sludge removed from the image carrier, such as a transfer belt, gravitates into the waste-sludge receiver and is discharged by the blade. Thus, accumulation of the waste sludge in the waste-sludge receiver is prevented.

Furthermore, in the image forming apparatus comprising the waste-sludge discharging unit according to the embodiment of the present invention, since the waste sludge removed from the transfer belt and transferred into the waste-sludge receiver is moved out of the waste-sludge receiver, image deterioration or leakage generated due to accumulation of the waste sludge can be prevented. Accordingly, the lifespan of the image cartridge in the image forming apparatus can be relatively improved.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWING FIGURES

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
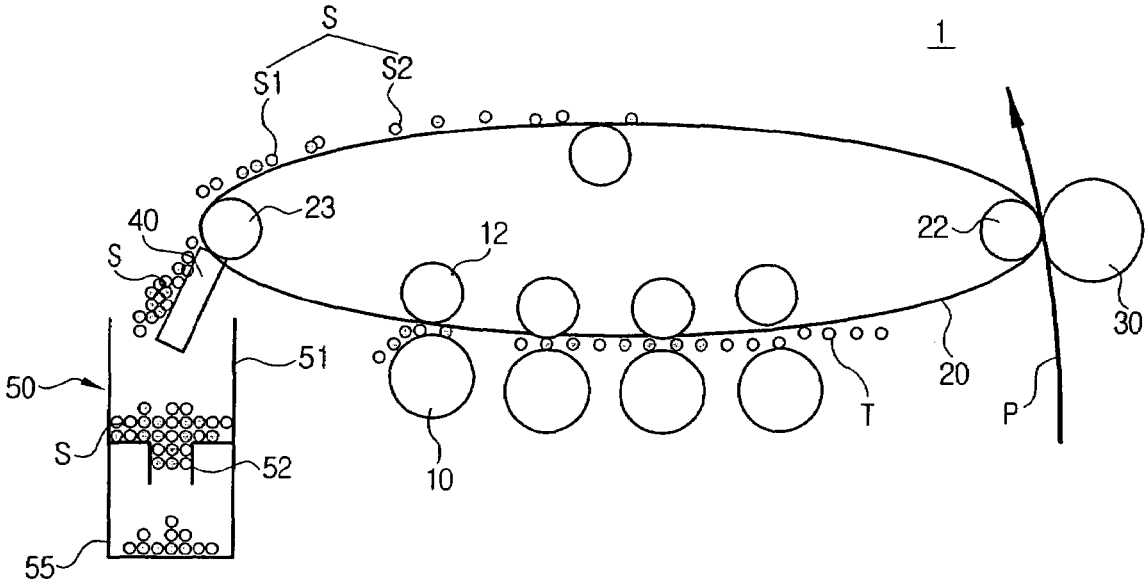
FIG. 1 (PRIOR ART)
FIG. 1 is a conception view showing an image forming apparatus including a conventional waste-sludge discharging unit.
Figure 2:
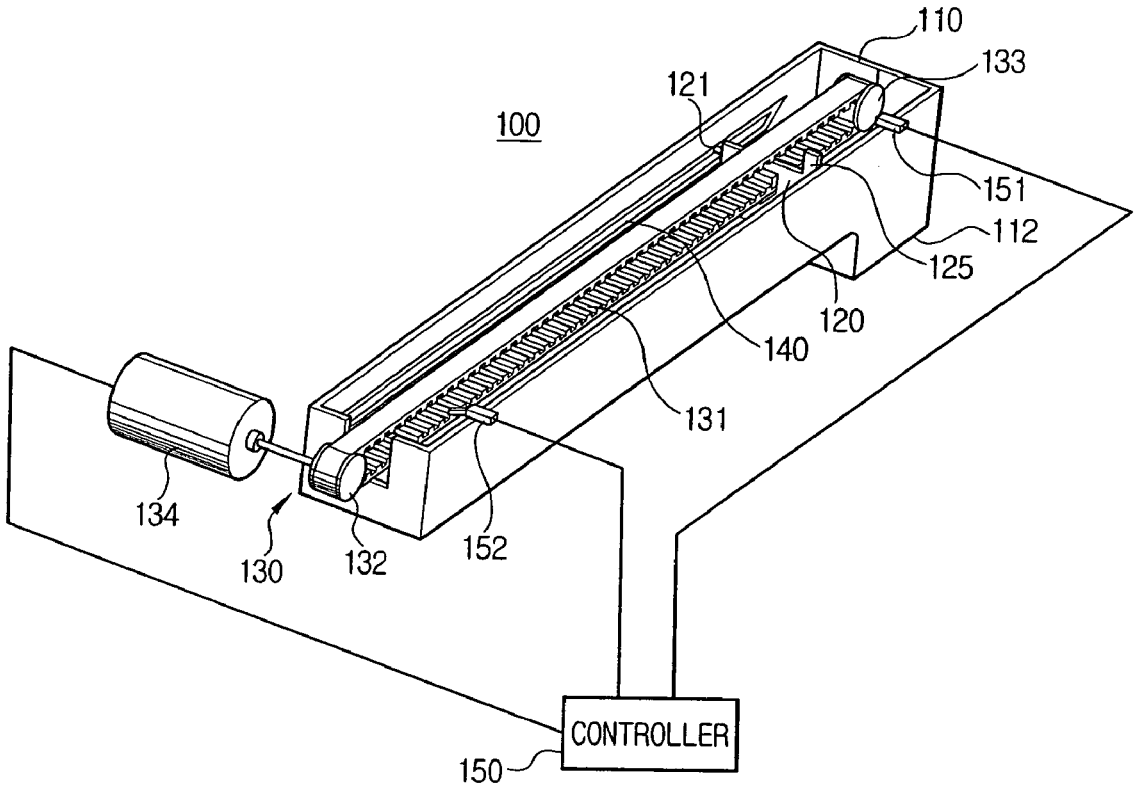
FIG. 2 is a perspective view of a waste-sludge discharging unit according to an embodiment of the present invention.
Figure 3:
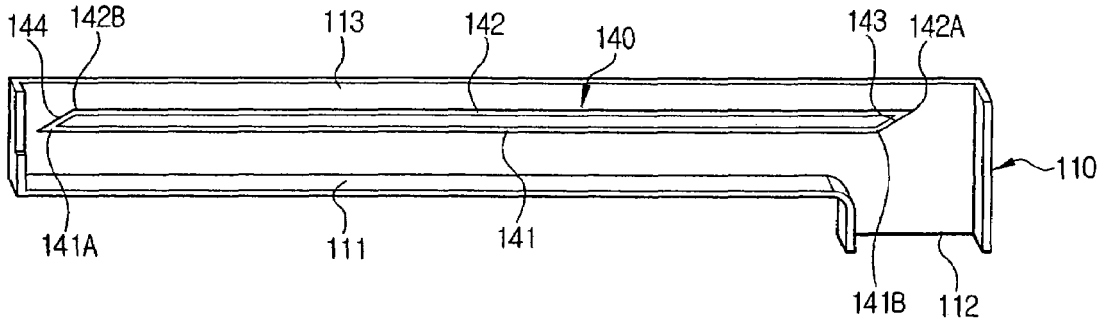
FIG. 3 is a view of a guide groove formed on a sidewall of a waste-sludge receiver of the waste-sludge discharging unit of FIG. 2.

Referring to FIGS. 2 and 3, a waste-sludge discharging unit 100 according to an embodiment of the present invention comprises a waste-sludge receiver 110, a blade 120 and a blade mover 130.

Figure 7:
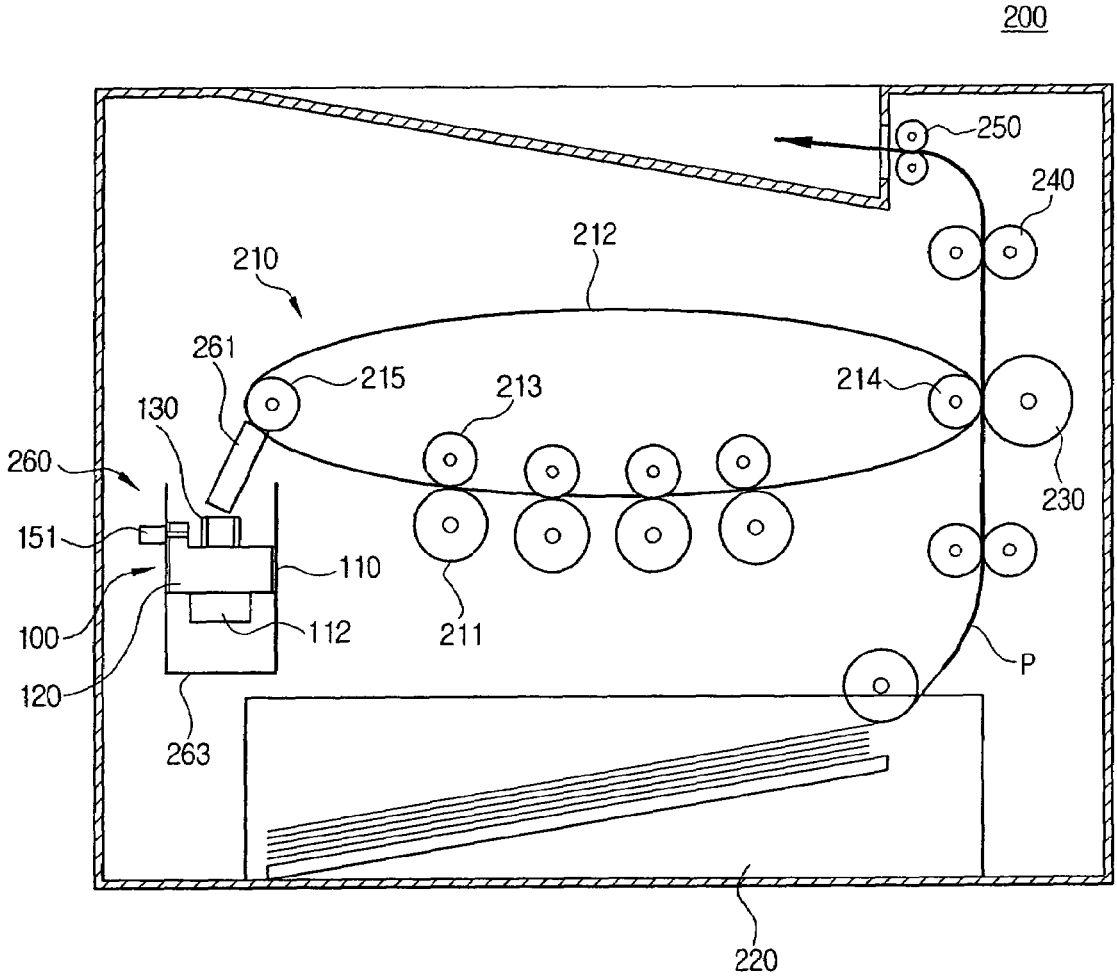
FIG. 7 is a schematic view of an image forming apparatus having the waste-sludge discharging unit according to an embodiment of the present invention.

The waste-sludge receiver 110 is disposed to receive waste sludge S removed and gravitating from an image carrier. An image developed by a developer is formed on the image carrier, such as a transfer belt 212 (FIG. 7). The waste sludge S is preferably removed by a cleaning blade 261 (FIG. 7). An outlet 112 is formed on one side of a bottom of the waste-sludge receiver 110 to remove the waste sludge S from the waste-sludge receiver 110. Generally, a waste-sludge storage unit 263 (FIG. 7) is provided under the outlet 112 to store the waste sludge S discharged through the outlet 112.

The blade 120 is formed to discharge the waste sludge S which accumulates on a bottom 111 of the waste-sludge receiver 110 to the outlet 112. Since the blade 120 has a section corresponding to an inside of the waste-sludge receiver 110, the waste sludge S accumulated on the bottom 111 of the waste-sludge receiver 110 can be thoroughly wiped away without remaining on the bottom 111 as the blade 120 moves in contact with the bottom 111.

The blade mover 130 moves the blade 120 so that the blade 120 can push out the waste sludge S accumulated on the bottom 111 of the waste-sludge receiver 110 to the outlet 112. Preferably, the blade mover 130 moves the blade 120 in contact with the bottom 111 of the waste-sludge receiver 110 only when moving the blade 120 toward the outlet 112.

The blade mover 130 comprises a belt 131 mounting the blade 120, a pair of pulleys 132 and 133 for guiding a caterpillar motion of the belt 131, and a motor 134 for driving the pulley 132. The pair of pulleys 132 and 133 facilitate the caterpillar motion of the belt 131.

The belt 131 is preferably resilient and may be a rubber flat belt or a timing belt for fixing and moving the blade 120. The pulleys 132 and 133, according to the type of belt 131, may be implemented as a flat-belt pulley or a timing-belt pulley. A bi-directional motor is preferably used for the motor 134.

The blade mover 130 further comprises a guide pin 121, a guide groove 140 to guide the movement of the guide pin 121, sensors 151 and 152 to detect the blade 120, and a controller 150 for controlling the motor 134 according to signals from the sensors 151 and 152.

The guide groove 140 comprises lower and upper linear parts 141 and 142 disposed parallel with the bottom 111 of the waste-sludge receiver 110. The lower linear part 141 is disposed so that the blade 120 contacts with the bottom 111 when the guide pin 121 moves along the lower linear part 141. The upper linear part 142 is disposed so that the blade 120 does not contact with the bottom 111 when the guide pin 121 moves along the upper linear part 142. The lower and the upper linear parts 141 and 142 of the guide groove 140 form a substantially closed curve through both ends thereof for fluid connection with each other. Therefore, the guide pin 121 may be inserted in and moved along the guide groove 140 so as to circulate around the lower and the upper linear parts 141 and 142 continuously. FIG. 3 shows an example of the guide groove 140. The guide groove 140 in FIG. 3 is substantially parallelogram shaped and disposed parallel with the bottom 111 of the waste-sludge receiver 110. However, this is only exemplary and it should be understood that the guide groove 140 may have other various forms, such as arc. The guide pin 121 is arranged between the upper linear part 142 and the lower linear part 141 to guide the guide pin 121. The guide pin 121 is arranged between the lower linear part 141 and the upper linear part 142. The guide pin 121 is configured for the movement by the belt 131. The guide groove 140 may be formed on a separate board (not shown) and mounted to the waste-sludge receiver 110. However, it is preferable to form the guide groove 140 directly on a sidewall 113 of the waste-sludge receiver 110.

The guide pin 121 is disposed on one side of the blade 120 to move along the guide groove 140.

Although the guide groove 140 and the guide pin 121 are formed only on one side of the blade 120 in the above embodiment, they can be provided on opposite sides of the blade 120 to guide the blade 120 more stably.

The sensors 151 and 152 are disposed on opposite sides of the waste-sludge receiver 110, respectively, to detect when the blade 120 arrives at the ends of the lower and upper linear parts 141 and 142. The first sensor 151 is disposed near the outlet 112 of the waste-sludge receiver 110 to detect when the blade 120 passes by a lower ending point 141B. In other words, the first sensor 151 detects blade 120 separation from the bottom 111 of the waste-sludge receiver 110. The second sensor 152 is disposed on the opposite side to the outlet 112 to detect the blade 120 passing by an upper ending point 142B of the upper linear part 142 of the guide groove 140. More specifically, the second sensor 152 detects when the blade 120 is in contact with the bottom 111 of the waste-sludge receiver 110. A proximity sensor may be used for the sensors 151 and 152. Moreover, a limit switch having a lever is operated by the blade 120 and is preferably employed. In this case, a dog part 125 for operating the limit switch is provided on an upper part of the blade 120.

The controller 150 controls a rotational direction of the motor 134 according to the signals from the sensors 151 and 152. When the first sensor 151 is turned on, the controller 150 rotates the motor 134 backwards so that the blade 120 moves toward the second sensor 152. When the second sensor 152 is turned on, the controller 150 rotates the motor 134 forward again so that the blade 120 moves toward the first sensor 151.

Figure 4:
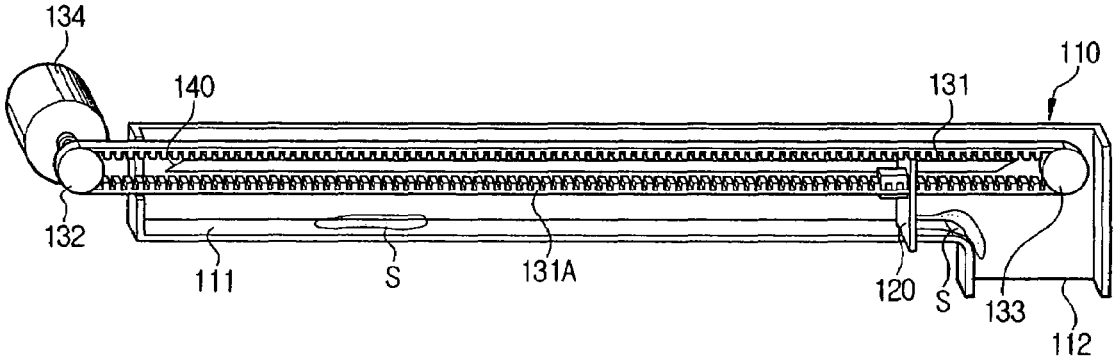
FIG. 4 is a sectional, perspective view showing a process of discharging a waste sludge dropped in the waste-sludge receiver, by the waste-sludge discharging unit of FIG. 2.
Figure 5:
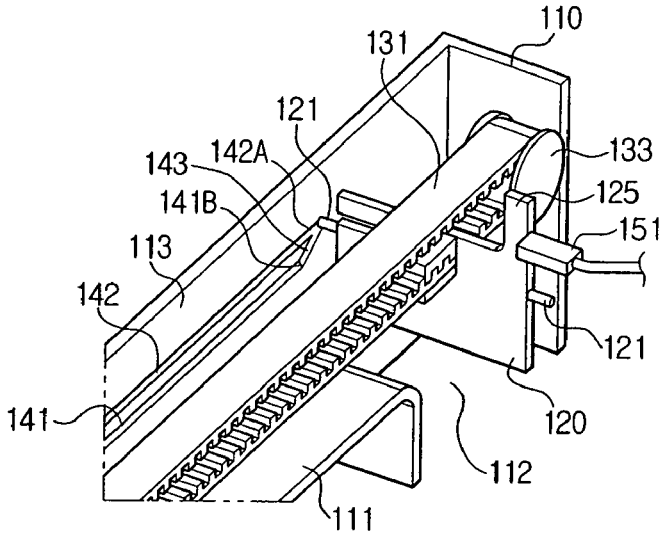
FIG. 5 is a sectional, perspective view showing a blade of the waste-sludge discharging unit of FIG. 2 arriving at an upper linear part of a guide groove.
Figure 6:
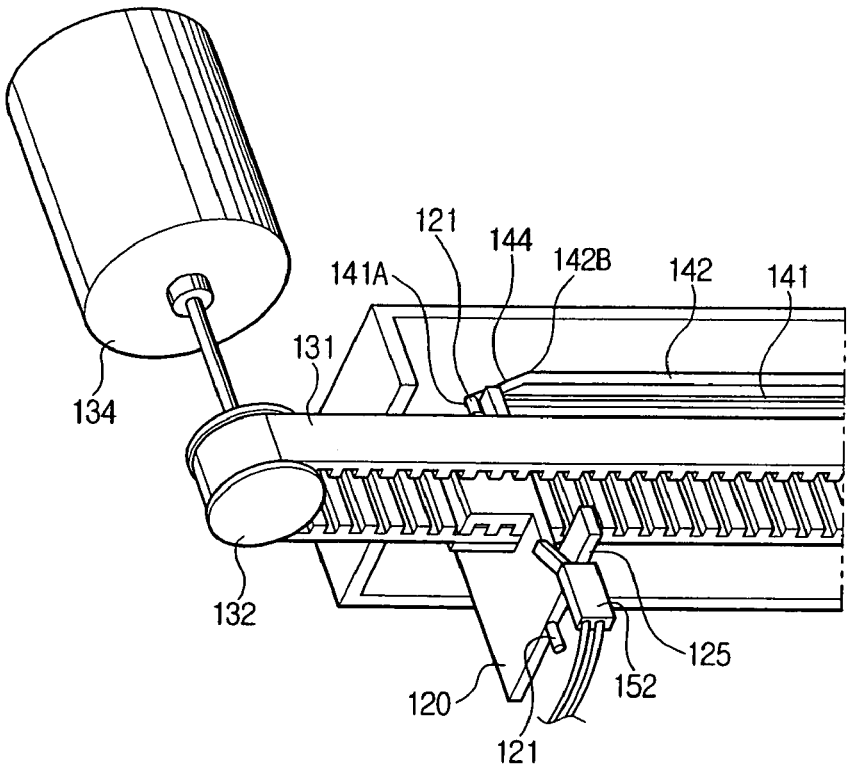
FIG. 6 is a sectional, perspective view showing a blade of the waste-sludge discharging unit of FIG. 2 arriving at a lower linear part of a guide groove.

Hereinbelow, the operation of the waste-sludge discharging unit 100 according to an embodiment of the present invention will be described with reference to accompanying FIGS. 4 through 6.

When the motor 134 rotates counterclockwise (hereinbelow, referred to as 'forward'), with the blade 120 in contact with the bottom 111 of the waste-sludge receiver 110, a lower belt 131A to which the blade 120 is fixed is moved by a driving pulley 132 and a driven pulley 133 from the left to the right. The blade 120 accordingly moves from the left to the right and pushes the waste sludge S on the bottom 111 of the waste-sludge receiver 110 toward the outlet 112. Therefore, the guide pin 121 of the blade 120 is guided by the lower linear part 141 of the guide groove 140. As the motor 134 keeps rotating forward, the guide pin 121 passes by the lower ending point 141B of the lower linear part 141 and a right slope 143 to the upper starting point 142A. At this time, the blade 120 separates from the bottom 111 of the waste-sludge receiver 110. The blade 120 is now located at an upper part of the outlet 112 and the dog part 125 of the blade 120 operates the first sensor 151.

When the first sensor 151 operates to output an on-signal, the controller 150 (FIG. 2) rotates the motor 134 clockwise (hereinbelow, referred to as 'backward'). When the motor 134 rotates backward, the lower belt 131A to which the blade 120 is fixed is moved by the pulleys 132 and 133 from the right to the left with respect to the drawing. Since the guide pin 121 of the blade 120 is guided by the upper linear part 142 of the guide groove 140, the blade 120 is moved out of contact with the bottom 111 of the waste-sludge receiver 110. Therefore, the blade 120 can move without pushing the waste sludge S accumulated on the bottom 111 toward the opposite side to the outlet 112. As the motor 134 keeps rotating backward, the guide pin 121 of the blade 120 passes by the upper ending point 142B and a left slope 144 for positioning at a lower starting point 141A. The dog part 125 of the blade 120 operates the second sensor 152.

When the second sensor 152 operates to output an on-signal, the controller 150 rotates the motor 134 forward again. When the motor 134 rotates forward, the blade 120 moves in contact with the bottom 111 of the waste-sludge receiver 110 and discharges the waste sludge S accumulated on the bottom 111 of the waste-sludge receiver 110 to the outlet 112.

The waste-sludge discharging unit 100 according to an embodiment of the present invention discharges the waste sludge S by repeating the above processes. Therefore, the waste sludge S does not accumulate on the waste-sludge receiver 110.

Although not shown, the waste-sludge discharging unit 100 may comprise a waste-sludge receiver, a blade, and a blade mover for operating the blade along a caterpillar track. Here, the blade mover comprises a unidirectional motor, a belt, and a pair of pulleys for guiding the caterpillar motion of the belt. The blade is fixed to the belt to move on a caterpillar track in one direction. Therefore, the blade contacts with a bottom of the waste-sludge receiver only when being located at a lower part of the caterpillar track to push a waste sludge toward an outlet. When being moved to an opposite side to the outlet along an upper part of the caterpillar track, the blade contacts again with the bottom of the waste-sludge receiver to push out the waste sludge.

Hereinbelow, an image forming apparatus 200 comprising a waste-sludge discharging unit 100 according to an embodiment of the present invention will be described with reference to FIGS. 7 and 8.

FIG. 7 is a schematic view of an image forming apparatus 200 having the waste-sludge discharging unit 100 according to an embodiment of the present invention. FIG. 8 is a partial, perspective view showing a transfer belt 212 and the waste-sludge discharging unit 100 of the image forming apparatus 200 of FIG. 7.

Figure 8:
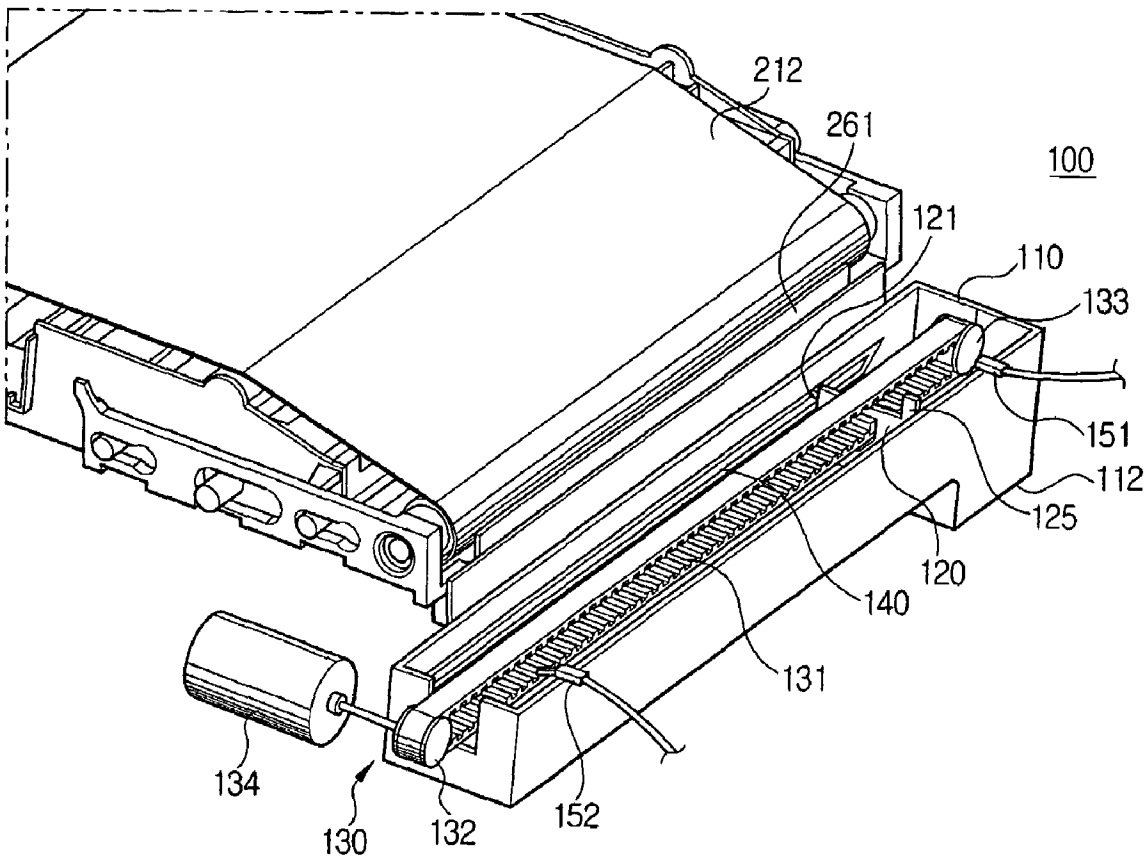
FIG. 8 is a partial, perspective view showing a transfer belt and the waste-sludge discharging unit of the image forming apparatus of FIG. 7.

Referring to FIGS. 7 and 8, the image forming apparatus 200 comprises an image cartridge 210 for forming a predetermined image, a paper feeding unit 220, a second transfer roller 230, a fixing unit 240, a paper discharging roller 250 and a cleaning system 260.

The image cartridge 210 comprises a plurality of photoconductive drums 211 on which electrostatic latent images are formed by a laser beam projected from a laser scanning unit (not shown). A plurality of developing units (not shown) are provided for developing the electrostatic latent images by respective color developers. Also provided is the transfer belt 212. Images developed on the photoconductive drums 211 are overlappingly transferred onto the transfer belt 212 to form a color image. Additionally, a plurality of first transfer rollers 213 for transferring the images developed on the plurality of photoconductive drums 211 to the transfer belt 212 are provided.

The second transfer roller 230 transfers the color image formed on the transfer belt 212 onto a printing medium P which is supplied to the second transfer roller 230 by the paper feeding unit 220. The fixing unit 240 fuses the color image transferred by the second transfer roller 230 onto the printing medium P. The paper discharging roller 250 discharges the printing medium P having thereon the fused image to the outside of the image forming apparatus 200.

The cleaning system 260 removes the waste sludge S. The cleaning system 260 comprises a cleaning blade 261 for removing the waste sludge S from the transfer belt 212. The waste-sludge discharging unit 100 discharges the waste sludge S removed by the cleaning blade 261 and a waste-sludge storage unit 263 stores the waste sludge S discharged from the waste-sludge discharging unit 100.

The cleaning blade 261 is disposed adjacent to a driven roller 215 of the transfer belt 212 to remove the waste sludge S attached on a surface of the transfer belt 212.

The waste-sludge discharging unit 100 comprises the waste-sludge receiver 110, the blade 120 and the blade mover 130.

The waste-sludge receiver 110 receives the waste sludge S being removed and dropped from the transfer belt 212 by the cleaning blade 261. The outlet 112 is formed on one side of the bottom 111 of the waste-sludge receiver 110 to drain out the dropped waste sludge S.

The blade 120 pushes out the waste sludge S which accumulates on the bottom of the waste-sludge receiver 110 toward the outlet 112. Since the blade 120 has a section corresponding to an inside of the waste-sludge receiver 110, the waste sludge S can be discharged through the outlet 112. Since the blade 120 is in contact with the bottom 111, waste sludge S does not accumulate in the waste-sludge receiver 110.

The blade mover 130 comprises the belt 131 for mounting the blade 120, a pair of the pulleys 132 and 133 to guide a caterpillar motion of the belt 131, and the motor 134 for driving the pulley 132. The pair of pulleys 132 and 133 facilitate the caterpillar motion of the belt 131. The guide pin 121 is disposed on opposite sides of the blade 120. The guide groove 140 is formed on opposite sides of the waste-sludge receiver 110 to movably guide the guide pin 121. The sensors 151 and 152 detect the blade 120, and the controller (not shown) to control the motor 134 according to the signals from the sensors 151 and 152. The above component parts have been already explained when describing the waste-sludge discharging unit 100.

The operation for removing the waste sludge S, will now be described.

Electrostatic latent images are formed by laser beams projected from the laser scanning unit on the plurality of photoconductive drums 211 according to a printing command. The electrostatic latent images are developed by liquid developers of certain colors, which are supplied by a developing unit. The images formed on the plurality of photoconductive drums 211 are overlappingly transferred onto the transfer belt 212 by the plurality of first transfer rollers 213, respectively. Thus, a color image is formed. The color image formed on the transfer belt 212 is transferred onto the printing medium P by the second transfer roller 230. After the transfer of the color image, a part of the liquid developer not being transferred to the printing medium P is left on the transfer belt 212 as waste sludge S. While the transfer belt 212 moves on the caterpillar track via a driving roller 214 and the driven roller 215, the waste sludge S remaining on the transfer belt 212 is removed from the transfer belt 212 by the cleaning blade 261 and streams along the cleaning blade 261. The waste sludge S streaming along the cleaning blade 261 is received into the waste-sludge receiver 110.

The waste sludge S gravitates to the bottom of the waste-sludge receiver 110 and is pushed by the blade 120 and discharged through the outlet 112. When being moved by the blade mover 130 toward the outlet 112, the blade 120 contacts the bottom 111 of the waste-sludge receiver 110. The blade 120 moves to the opposite side of the outlet 112, when the blade 120 separates from the bottom 111 by a certain distance. Accordingly, the blade 120 can effectively discharge the waste sludge S accumulated on the waste sludge receiver 110 through the outlet 112. Since the processes of the blade 120 for discharging the waste sludge S to the outlet 112 are the same as those of the waste-sludge discharging unit 100, detailed description thereof will be omitted for clarity and conciseness.

While the invention has been shown and described with reference to certain embodiments thereof, it will be understood by those skilled in the art that various changes in form and details may be made therein without departing from the spirit and scope of the invention as defined by the appended claims.

What is claimed is:

1. A waste-sludge discharging unit comprising:

a waste-sludge receiver for receiving waste sludge, the waste-sludge receiver having an outlet on one side of a bottom thereof;

a blade to push the waste sludge accumulated on the bottom of the waste-sludge receiver toward the outlet; and a blade mover to operate the blade.

2. The waste-sludge discharging unit of claim 1, wherein the blade contacts with the bottom of the waste-sludge receiver only when being moved toward the outlet.

3. The waste-sludge discharging unit of claim 2, the blade mover comprises:

a belt for mounting the blade;

a pair of pulleys to guide a caterpillar motion of the belt; and a motor to drive one of the pair of pulleys.

4. The waste-sludge discharging unit of claim 3, wherein the blade mover further comprises:

a guide pin formed on one side of the blade; and a guide groove formed as a substantially closed curve comprising two linear parts disposed parallel with the bottom of the waste-sludge receiver to movably guide the guide pin.

5. The waste-sludge discharging unit of claim 4, wherein the blade mover further comprises a sensor to detect the blade.

6. The waste sludge discharging unit of claim 5, wherein the blade further comprises a dog part to operate the sensor.

7. The waste-sludge discharging unit of claim 4, wherein the guide groove is substantially formed as a parallelogram.

8. The waste-sludge discharging unit of claim 4, wherein the guide groove is formed on an inner side of the waste-sludge receiver.

9. A waste-sludge discharging unit comprising:

a waste-sludge receiver for receiving waste sludge, the waste-sludge receiver having an outlet on one side of a bottom thereof;

a blade to push the waste sludge accumulated on the bottom of the waste-sludge receiver toward the outlet; and a blade mover to operate the blade, the blade mover configured for positioning on a belt, a pair of pulleys to guide a caterpillar motion of the belt and a motor to drive at least one of the pair of pulleys.

10. The waste-sludge discharging unit of claim 9, wherein the blade contacts with the bottom of the waste-sludge receiver only when being moved toward the outlet.

11. The waste-sludge discharging unit of claim 9, wherein the blade mover further comprises:

a guide pin formed on one side of the blade; and a guide groove formed as a substantially closed curve comprising two linear parts disposed parallel with the bottom of the waste-sludge receiver to movably guide the guide pin.

12. The waste-sludge discharging unit of claim 9, wherein the blade mover further comprises a sensor to detect the blade.

13. The waste sludge discharging unit of claim 12, wherein the blade further comprises a dog part to operate the sensor.

14. An image forming apparatus comprising:

an image carrier;

a cleaning blade to remove waste sludge remaining on the image carrier;

a waste-sludge receiver disposed to receive the waste sludge removed and gravitating from the image carrier by the cleaning blade, the waste-sludge receiver having an outlet on a bottom thereof;

a blade pushing the waste sludge accumulated on the bottom of the waste-sludge receiver out to the outlet; and a blade mover to operate the blade.

15. The image forming apparatus of claim 14, wherein the blade contacts with the bottom of the waste-sludge receiver only when being moved toward the outlet.

16. The image forming apparatus of claim 15, the blade mover comprises:

a belt with the blade arranged thereon;

a pair of pulleys to guide a caterpillar motion of the belt; and a motor to drive at least one of the pair of pulleys.

17. The image forming apparatus of claim 16, wherein the blade mover further comprises:

a guide pin formed on one side of the blade; and a guide groove formed as a closed curve comprising two linear parts disposed parallel with the bottom of the waste-sludge receiver to movably guide the guide pin; and whereby, when the guide pin moves along a lower linear part of the guide groove, the blade moves in contact with the bottom of the waste-sludge receiver.

18. The image forming apparatus of claim 17, wherein the blade mover further comprises a sensor to detect the blade, and a dog part formed on the blade to operate the sensor.

19. The image forming apparatus of claim 17, wherein the guide groove is substantially formed as a parallelogram.

20. The image forming apparatus of claim 17, wherein the guide groove is formed on an inner side of the waste-sludge receiver.

* * * * *